US011655520B2

(12) United States Patent
Sakai et al.

(10) Patent No.: US 11,655,520 B2
(45) Date of Patent: May 23, 2023

(54) STEEL SHEET ANNEALING METHOD AND STEEL SHEET ANNEALING FURNACE

(71) Applicant: JFE Steel Corporation, Tokyo (JP)

(72) Inventors: Ken Sakai, Tokyo (JP); Shinichi Kitamura, Tokyo (JP); Kohei Kurihara, Tokyo (JP); Yusuke Ota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/976,898

(22) PCT Filed: Feb. 6, 2019

(86) PCT No.: PCT/JP2019/004131

§ 371 (c)(1),
(2) Date: Aug. 31, 2020

(87) PCT Pub. No.: WO2019/171862

PCT Pub. Date: Sep. 12, 2019

(65) Prior Publication Data

US 2021/0040579 A1 Feb. 11, 2021

(30) Foreign Application Priority Data

Mar. 9, 2018 (JP) ..... JP2018-042645

(51) Int. Cl.
*C21D 9/56* (2006.01)
*C21D 1/26* (2006.01)

(52) U.S. Cl.
CPC ..... *C21D 9/563* (2013.01); *C21D 1/26* (2013.01)

(58) Field of Classification Search
None
See application file for complete search history.

(56) References Cited

U.S. PATENT DOCUMENTS 2,603,578 A 7/1952 Omitz
4,375,283 A * 3/1983 Shimoyama ..... C21D 9/56 266/102
4,702,869 A 10/1987 Higuchi et al.
5,244,621 A 9/1993 Wakai et al.
(Continued)

FOREIGN PATENT DOCUMENTS

CN 101263234 A 9/2008
CN 103889910 A 6/2014
(Continued)

OTHER PUBLICATIONS

Machine Translation of JP-2001253762-A (Year: 2001).*
(Continued)

*Primary Examiner* — Kevin E Yoon
*Assistant Examiner* — Ryan L Heckman
(74) *Attorney, Agent, or Firm* — RatnerPrestia

(57) ABSTRACT

A method of annealing a steel sheet in an annealing furnace, including: supporting and conveying a steel sheet with hearth rolls; and supporting and conveying the steel sheet with a full-ceramic hearth roll as a hearth roll located in an area where a furnace temperature is equal to or higher than 950° C., wherein a main constituent of the full-ceramic hearth roll is silicon nitride with use of an Al—Y-based sintering aid.

6 Claims, 3 Drawing Sheets

(56) References Cited

U.S. PATENT DOCUMENTS

| | | | | |
|---|---|---|---|---|
| 5,603,877 | A | 2/1997 | Kato et al. | |
| 5,665,291 | A | 9/1997 | Honma et al. | |
| 9,200,668 | B2 * | 12/2015 | Lacombe | F27D 3/026 |
| 10,337,082 | B2 | 7/2019 | Fukunaga | |
| 2004/0178043 | A1 * | 9/2004 | Brinkmeier | C21D 9/0012 193/37 |
| 2008/0296813 | A1 * | 12/2008 | Joo | C21D 1/00 266/274 |
| 2013/0139929 | A1 * | 6/2013 | Francoeur | C22C 38/02 148/111 |
| 2017/0275730 | A1 | 9/2017 | Kurisu et al. | |
| 2017/0275731 | A1 * | 9/2017 | Fukunaga | C21D 9/563 |

FOREIGN PATENT DOCUMENTS

| | | | | | |
|---|---|---|---|---|---|
| CN | 105002350 | A | | 10/2015 | |
| CN | 106715727 | A | | 5/2017 | |
| EP | 0292953 | A1 | * | 3/1993 | |
| JP | 57137419 | A | | 8/1982 | |
| JP | S6324036 | A | * | 2/1988 | C21D 9/563 |
| JP | H0633944 | B2 | * | 12/1988 | C21D 1/773 |
| JP | 03173721 | A | * | 7/1991 | |
| JP | 1030128 | A | | 2/1998 | |
| JP | 11267734 | A | | 10/1999 | |
| JP | 2001031477 | A | | 2/2001 | |
| JP | 2001253762 | A | | 9/2001 | |
| JP | 2001253762 | A | * | 9/2001 | |
| JP | 2002012961 | A | | 1/2002 | |
| JP | 2009228072 | A | | 10/2009 | |
| JP | 2016074931 | A | | 5/2016 | |
| TW | 201522275 | A | | 6/2015 | |
| TW | 201623637 | A | | 7/2016 | |
| WO | WO-2008150205 | A1 | * | 12/2008 | C21D 9/0012 |

OTHER PUBLICATIONS

Machine Translation of JP-03173721-A (Year: 1991).*
Machine Translation of JPH0633944B2 (Year: 1988).*
Machine Translation of JPS6324036A (Year: 1988).*
Machine Translation of EP0292953A1 (Year: 1993).*
Extended European Search Report for European Application No. 19 763 369.6, dated Mar. 19, 2021, 6 pages.
Hirasaki et al., "Sintering of Y2O3-Al2O3-Doped β-Si3N4 Powder and Mechanical Properties of Sintered Materials", Journal of the Ceramic Society of Japan, 102 [6], 1994, pp. 790-794.
International Search Report and Written Opinion for International Application PCT/JP2019/004131, dated May 7, 2019, 6 pages.
Taiwanese Notice of Reason for Refusal for Taiwanese Application No. 108107280, dated Jun. 17, 2019, 7 pages.
Shi, R., et al., "Effects of Sintering Aids on Microstructure and Properties of Silicon Nitride Ceramics", Dec. 31, 2003, 5 pages, Modern Technical Ceramics, vol. 3 (abstract only).
Xu, G., et al., "Discussion of Improving Method on the Structure of Roller in Annealing Furnace", Jul. 31, 2007, 3 pages, Ceramic Science and Art (abstract only).
Chinese Office Action with Search Report for Chinese Application No. 201980017563.2, dated Sep. 1, 2021, 9 pages.
Chinese Office Action for Chinese Application No. 201980017563.2, dated Feb. 23, 2022, with Concise Statement of Relevance of Office Action, 7 pages.

* cited by examiner

STEEL SHEET ANNEALING METHOD AND STEEL SHEET ANNEALING FURNACE

CROSS REFERENCE TO RELATED APPLICATIONS

This is the U.S. National Phase application of PCT/JP2019/004131, filed Feb. 6, 2019, which claims priority to Japanese Patent Application No. 2018-042645, filed Mar. 9, 2018, the disclosures of these application being incorporated herein by reference in their entireties for all purposes.

FIELD OF THE INVENTION

The present invention relates to a steel sheet annealing method and a steel sheet annealing furnace.

BACKGROUND OF THE INVENTION

Generally, in a production line of steel sheets such as thin steel sheets, a process of annealing a rolled steel sheet is carried out prior to a predetermined process, such as application of surface coating. The surface layer of a hearth roll used in an annealing furnace is required to be made of a material having properties such as a high thermal resistance and a high thermal expansion resistance under a high-temperature condition, as well as a moderate hardness, and, generally, a carbon material of a metallic graphite core body is used. For example, Patent Literatures 1 and 2 disclose that a graphitic carbon material having a carbon purity equal to or higher than 98%, a bulk specific gravity equal to or more than 1.65, a specific resistance equal to or less than 1000 μΩ·cm, and a degree of graphitization equal to or more than 0.60 is suitable as the material of the roll, for a use in a temperature equal to or higher than 800° C. Furthermore, Patent Literature 3 discloses that, if a roll made of the material disclosed in Patent Literatures 1 and 2 is used in a temperature equal to or higher than 900° C., degradation due to oxidization spreads very quickly during the use, because of the low Shore hardness of the material, and result in local formation of recesses on the roll surface, and such recesses become a cause of a pickup. Therefore, Patent Literature 3 discloses that a roll having properties of a hardness equal to or more than 50, a porosity between 5% to 15%, and a degree of graphitization equal to or higher than 0.6% is most suitable.

PATENT LITERATURE

Patent Literature 1: U.S. Pat. No. 2,603,578
Patent Literature 2: Japanese Examined Patent Application Laid-open No. S44-3694
Patent Literature 3: Japanese Patent Application Laid-open No. S57-137419

SUMMARY OF THE INVENTION

Patent Literature 3 discloses that pickups can be suppressed effectively by increasing the Shore hardness of the roll. However, according to some experiments carried out by the inventors of the present invention, when a steel sheet having a high Si content (e.g., a Si content of 3% or so) was annealed in an annealing process in a temperature equal to or higher than 950° C., pickups occurred, even on a carbon roll having properties within the ranges disclosed in Patent Literature 3. In other words, the inventors found out that pickups cannot be suppressed sufficiently merely by increasing the Shore hardness of the roll.

Aspects of the present invention have been made in consideration of the issue described above, and an object according to aspects of the present invention is to provide a steel sheet annealing method and a steel sheet annealing furnace capable of suppressing pickups sufficiently even in a temperature equal to or higher than 950° C.

To solve the problem and achieve the object, a method of annealing a steel sheet according to aspects of the present invention in an annealing furnace including hearth rolls configured to support and convey a steel sheet. The method includes: using a full-ceramic hearth roll as a hearth roll located in an area where a furnace temperature is equal to or higher than 950° C., wherein a main constituent of the full-ceramic hearth roll is silicon nitride with use of an Al—Y-based sintering aid.

Moreover, the method of annealing the steel sheet according to aspects of the present invention further includes: a step of adjusting a torque of each hearth rolls such that a difference between a torque of the full-ceramic hearth roll and a torque of the hearth roll made of another material becomes equal to or smaller than 5%, when the full-ceramic hearth roll is used together with the hearth roll made of another material in the annealing furnace.

Moreover, a steel sheet annealing furnace according to aspects of the present invention including hearth rolls configured to support and convey a steel sheet. The annealing furnace includes: a full-ceramic hearth roll located in an area where a furnace temperature is equal to or higher than 950° C., wherein a main constituent of the full-ceramic hearth roll is silicon nitride with use of an Al—Y-based sintering aid.

Moreover, the steel sheet annealing furnace according to aspects of the present invention further includes: a torque adjusting means configured to adjust a torque of each hearth rolls such that a difference between a torque of the full-ceramic hearth roll and a torque of the hearth roll made of another material becomes equal to or smaller than 5%, when the full-ceramic hearth roll is used together with the hearth roll made of another material in the annealing furnace.

With the steel sheet annealing method and the annealing furnace according to aspects of the present invention, it is possible to suppress pickups sufficiently, even in a temperature equal to or higher than 950° C.

DETAILED DESCRIPTION OF EMBODIMENTS OF THE INVENTION

Figure 1:
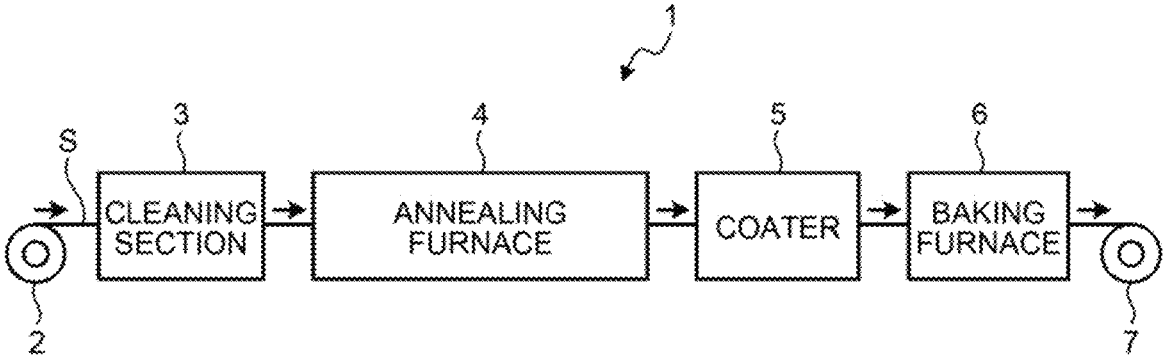
FIG. 1 is a general schematic illustrating a configuration of a steel sheet annealing line that uses a steel sheet annealing method according to one embodiment of the present invention.

The inventors of the present invention made efforts to come up with a hearth roll causing an extremely small number of pickups even in a temperature equal to or higher than 950° C., in an annealing process of a steel sheet with a high Si content. Carbon, which is a common roll material, goes through oxidation-reduction reactions with iron powder or the like on the surface of the steel sheet, and, as a result of the reactions, recesses are formed locally on the roll surface. The recesses then become filled with agglomerates, such as those of iron powder, and such agglomerates grow as the agglomerates are rubbed and rotated against the steel sheet. Chunks of the grown agglomerates then protrude from the roll surface and cause pickups. Focusing on this point, the inventors carried out a research on a ceramic, as a material that is less reactive to a steel sheet. As a result of conducting a research on sintering aids, the inventors confirmed that, a ceramic using a Mg-based sintering aid reacts with Al or Si on the steel sheet surface (goes through reactions such as $4Al_2O_3+3Mg \rightarrow 3Al_2MgO_4+2Al$), and the reactions induce pickups, because Mg becomes easily oxidized. However, it was confirmed that a ceramic using an Al—Y-based sintering aid does not react with the steel sheet, has the surface layer that remains clean, and exhibits a high pickup resistance, whereas recesses, which can originate pickups, are formed on the surface layer of the carbon roll. Based on the above-described fact, the ceramic preferably contains 5 weight % to 20 weight % of $Al_2O_3$ and $Y_2O_3$, as a sintering aid.

The inventors also carried out some experiments on a roll with a ceramic sleeve, having a layer of ceramic laid on the surface layer of a metallic roll, in order to achieve a cost reduction, and confirmed that the axial vibration increases after a long use, and such a roll was found out to be unsuitable for commercialization from the viewpoint of durability. By contrast, it was confirmed that a full-ceramic hearth roll in which the entire shaft portion and roll body are made of ceramic experiences less axial vibration compared with a carbon hearth roll, and has better durability. Based on these results, with a full-ceramic hearth roll, a repair cost can be reduced. Furthermore, although hearth rolls made of carbon or a heat-resistant alloy are generally used as the hearth rolls in an annealing furnace, it was found out that, when such hearth rolls are used together with a full-ceramic hearth roll, and the circumferential velocities of the respective rolls are set constant, the surface of a hearth roll made of materials other than the ceramic and located near the full-ceramic hearth roll become degraded, and pickups are promoted by the degradations. This is due to lost balance in the amounts of the steel sheet transported by the respective rolls because different materials have different friction coefficients. To address this issue, the inventors adjusted the toques of the respective hearth rolls approximately to the same level, and succeeded in reducing the frequency of occurrence of pickups on the carbon hearth roll or the heat-resistant alloy hearth roll that is used near the full-ceramic hearth roll to the level that is the same as those on the other carbon hearth rolls. Based on the above-described fact, it was confirmed that, by making torque adjustments, it is possible to implement an operation using a full-ceramic hearth roll together with hearth rolls made of other materials, and to introduce ceramic hearth rolls incrementally and selectively.

Examples of the hearth rolls made of the other materials include a carbon hearth roll and a hearth roll made of a heat-resistant steel or a heat-resistant alloy.

A steel sheet annealing method according to one embodiment of the present invention will now be explained with reference to some drawings.

Figure 2:
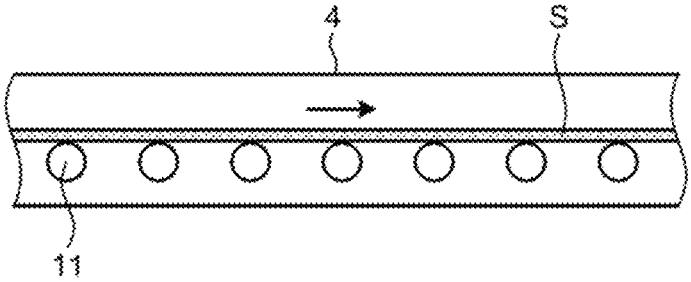
FIG. 2 is a general schematic illustrating how a steel sheet is conveyed in the annealing furnace illustrated in FIG. 1.

FIG. 1 is a general schematic illustrating a configuration of a steel sheet annealing line that uses the steel sheet annealing method according to one embodiment of the present invention. FIG. 2 is a general schematic illustrating how a steel sheet S is conveyed in an annealing furnace 4 illustrated in FIG. 1. As illustrated in FIG. 1, in this steel sheet annealing line 1 that uses the steel sheet annealing method according to the one embodiment of the present invention, the steel sheet S taken out of a coil 2 on the incoming side is washed with alkali in a cleaning section 3 so that rolling oil, iron powders, and the like attached on the surface are removed. The steel sheet S is then annealed continuously inside of the annealing furnace 4. As illustrated in FIG. 2, the steel sheet S is supported and conveyed horizontally by hearth rolls 11 inside the annealing furnace 4 in such a manner that the steel sheet S does not become distorted. Referring back to FIG. 1, the steel sheet S annealed in the annealing furnace 4 is sent to a coater 5, and the coater 5 applies a coating liquid to the surface of the steel sheet S. The steel sheet S having the surface applied with the coating liquid is conveyed into a baking furnace 6, and the coating liquid is dried and baked in the baking furnace 6. The steel sheet S is then wound as a coil 7, on the outgoing side of the annealing line 1.

A hearth roll according to aspects of the present invention is a full-ceramic hearth roll in which a main constituent of the entire shaft portion and roll body is silicon nitride with the use of an Al—Y-based sintering aid, and is capable of exerting an effect of reducing pickups sufficiently when deployed in an area where the furnace temperature reaches a temperature equal to or higher than 950° C., or preferably equal to or higher than 900° C., in the annealing furnace 4. Furthermore, when this full-ceramic hearth roll is used together with a carbon hearth roll as the hearth rolls 11, torque adjustments are needed. Without the torque adjustments, the surface layer of the carbon hearth roll located near the full-ceramic hearth roll becomes degraded, and, as chunks of agglomerates of powders are rubbed and rotated against the steel sheet, and the chunks grow on the surface layer, and the chunks of the grown agglomerates protrude from the roll surface, and cause pickups. The torque herein means a driving force for causing a roll to rotate. The torque can be interpreted as a current level in the driving motor, for example, and an acceptable range of a difference between the current levels for the respective rolls is equal to or less than 5%. The torque can be adjusted by changing the circumferential velocities of the rolls, that is, by changing the forward slips for the respective rolls, for example.

Examples

Figure 3:
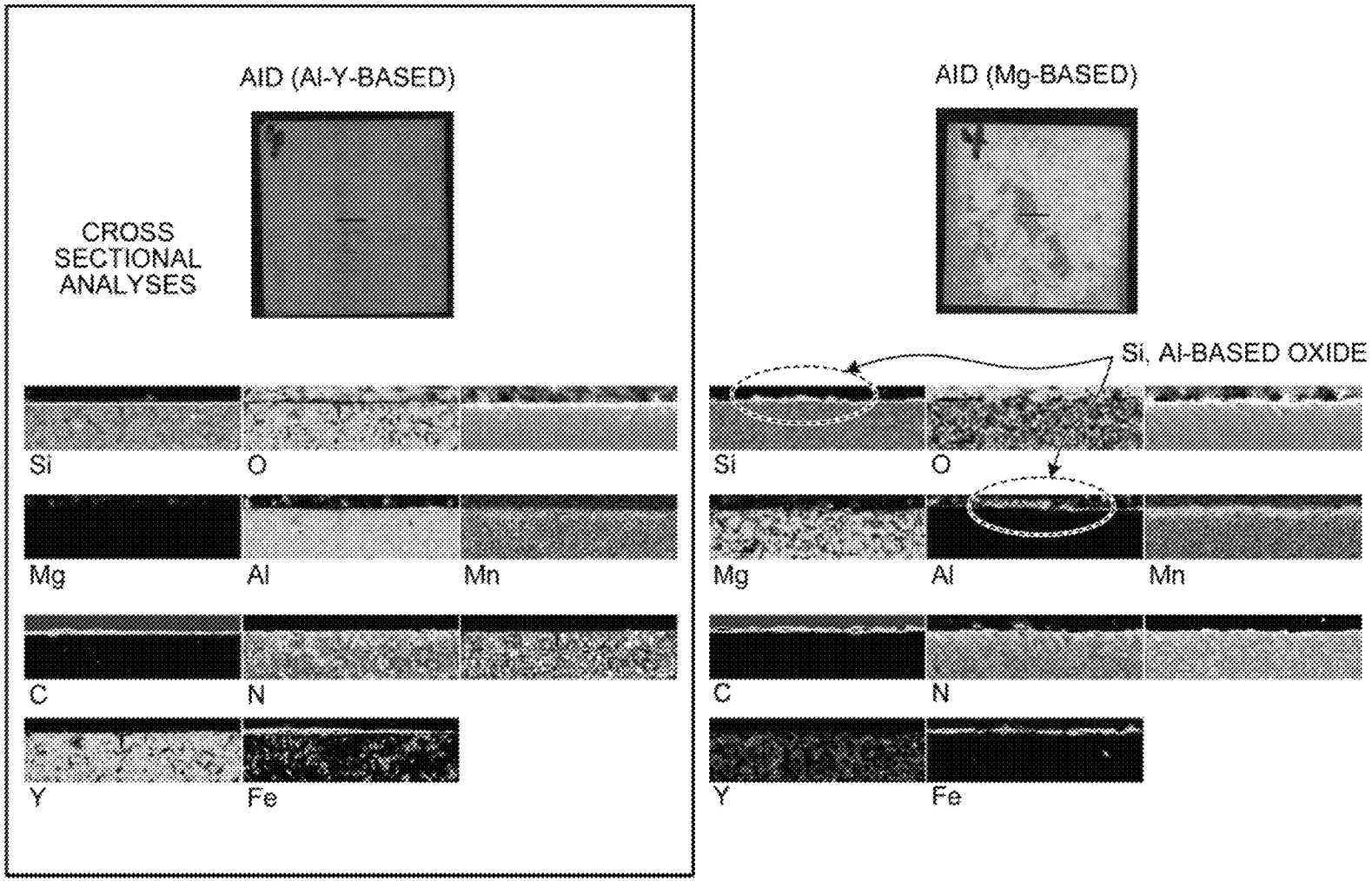
FIG. 3 is a schematic illustrating results of cross sectional analyses with EPMA.

In this example, sintering aids for a ceramic hearth roll were examined through experiments. Specifically, ceramic hearth roll pieces (15t×18w×38L) using an Al—Y-based sintering aid and a Mg-based sintering aid, respectively, were placed on powder of a steel sheet containing 3.3 mass % of Si and 0.7 mass % of Al, and a 383-gram weight was placed on the ceramic hearth roll pieces to adjust the surface pressure. The hearth roll pieces were then left in an atmosphere of 20% $H_2$—$N_2$ with a dew point set to −40° C. for one hour with the temperature being kept at 1050° C. As a result, reactant was found only on the surface of the ceramic hearth roll piece with the Mg-based sintering aid. The results of cross sectional analyses of the ceramic hearth roll pieces using an Electron Probe Micro Analyzer (EPMA) is illustrated in FIG. 3. As illustrated in FIG. 3, the reactant observed on the surface layer of the ceramic hearth roll with the Mg-based sintering aid was found to be an oxide resultant of a reaction with Si or Al in the steel sheet.

Figure 4:
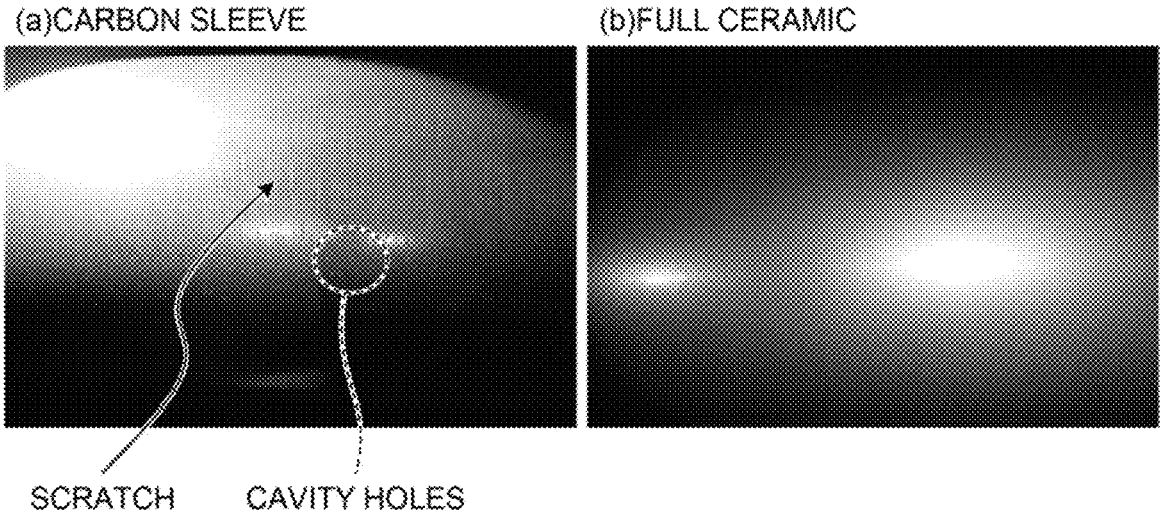
FIG. 4 is a schematic illustrating results of roll surface observations.
Figure 5:
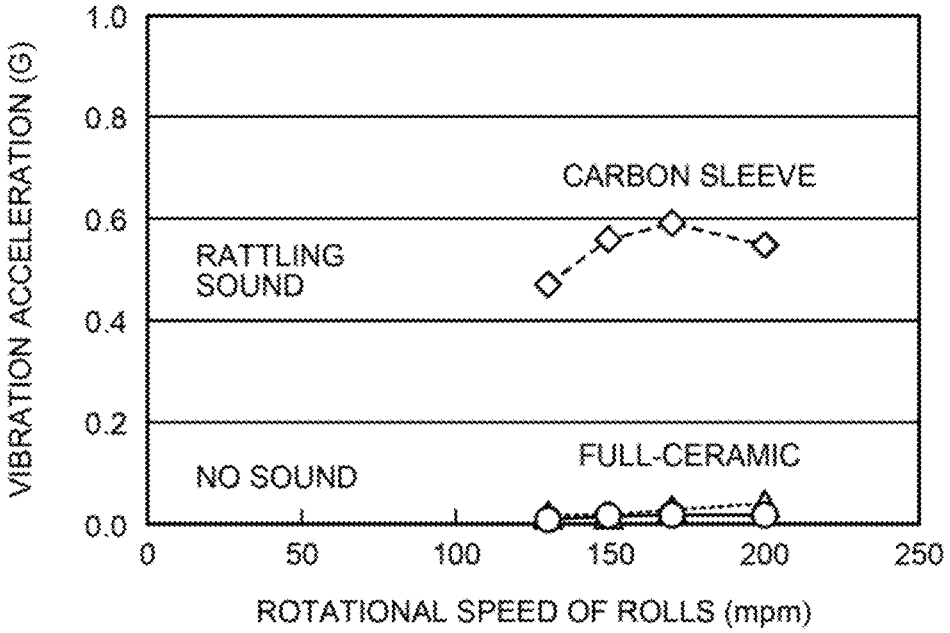
FIG. 5 is a schematic illustrating results of axial vibration measurements.

In addition, in an annealing furnace for annealing a steel sheet the Si content of which was 1 mass % or more, a carbon sleeve roll and a full-ceramic hearth roll were used for seven months, in an area where the furnace temperature was kept equal to or higher than 950° C., and the roll surfaces were observed, and measurements of their axial vibrations were collected. The results of the roll surface observations and the axial vibration measurements are indicated in FIGS. 4(*a*), 4(*b*), and 5, and Table 1. As indicated in FIGS. 4(*a*) and 4(*b*), scratches and cavity holes, which can originate pickups, were observed on the carbon sleeve roll (No. 4), but the full-ceramic hearth roll (No. 1) with the use of the Al—Y-based sintering aid had no damage at all, and remained in a very good condition. Furthermore, as illustrated in FIG. 5, the carbon sleeve roll vibrated very much, and made rattling sound, but the full-ceramic hearth roll with the use of the Al—Y-based sintering aid did not vibrate very much, and made no noise. The ceramic sleeve roll was cracked after 2 months.

TABLE 1

| No. | Roll Type | Aid | Pickup/ Damage Condition | Vibrations | Remarks |
|---|---|---|---|---|---|
| 1 | Full | Al—Y | A | A | Example |
| 2 | Ceramic | Mg | C | A | Comparative Example |
| 3 | Ceramic Sleeve | Al—Y | A | C | Comparative Example |
| 4 | Carbon Sleeve | — | C | C | Comparative Example |

The full-ceramic hearth roll with the use of Al—Y-based sintering aid was used, in an annealing furnace for annealing a steel sheet with a Si content of 1 mass % or more, in an area where the furnace temperature was equal to or higher than 950° C., and the carbon sleeve roll was used in an area where the furnace temperature was lower than 950° C. The torque of the ceramic roll and that of the carbon sleeve roll were then changed variously, and the surfaces of the respective rolls were observed after the seven-month operation. The results of the roll surface observations are indicated in Table 2 below. As indicated in Table 2, when the torque difference was equal to or smaller than 1%, no formation of pickups was observed (evaluation: A). When the torque difference was 3% or 5%, some cavity holes, which could originate pickups, were formed (evaluation: B). When the torque difference exceeded 5%, obvious pickups such as dents or scratches were formed (evaluation: C). As a result, it was confirmed that, by setting the torque difference between the ceramic roll and the carbon sleeve roll equal to or smaller than 5%, pickups can be suppressed effectively even when a ceramic roll is used in a high-temperature area, together with a carbon sleeve roll used in the low-temperature area of the annealing furnace.

TABLE 2

| No. | Torque of Ceramic Roll | Torque of Carbon Roll | Torque Difference | Conditions of Pickup Formation |
|---|---|---|---|---|
| 1 | −4% | 5% | 9% | C |
| 2 | −3% | 4% | 7% | C |
| 3 | 0% | 5% | 5% | B |
| 4 | 1% | 4% | 3% | B |
| 5 | 3% | 4% | 1% | A |

Although some embodiments that are applications of the invention made by the inventors are explained above, the scope of the present invention is not limited to the embodiments including the descriptions and the drawings making up a part of disclosure of the present invention, in any way. In other words, other embodiments, examples, operation technologies, and the like made by a person skilled in the art on the basis of the embodiment all fall within the scope of the present invention.

INDUSTRIAL APPLICABILITY

According to aspects of the present invention, it is possible to provide a steel sheet annealing method and a steel sheet annealing furnace capable of suppressing pickups sufficiently even in a temperature equal to or higher than 950° C.

REFERENCE SIGNS LIST

1 steel sheet annealing line
2, 7 coil
3 cleaning section
4 annealing furnace
5 coater
6 baking furnace
11 hearth roll
S steel sheet

The invention claimed is:

1. A method of annealing a steel sheet in an annealing furnace, comprising:

supporting and conveying the steel sheet with hearth rolls; and supporting and conveying the steel sheet with a full-ceramic hearth roll located in an area where a furnace temperature is equal to or higher than 950° C., the full-ceramic hearth roll being a hearth roll in which an entire shaft portion and roll body are made of ceramic, wherein a main constituent of the full-ceramic hearth roll is silicon nitride with use of an Al—Y-based sintering aid; and adjusting a torque of each of the hearth rolls such that a difference between a torque of the full-ceramic hearth roll and a torque of one hearth roll of the hearth rolls made of another material becomes equal to or smaller than 5%, when the full-ceramic hearth roll is used together with the hearth roll made of another material in the annealing furnace.

2. The method of annealing the steel sheet according to claim 1, wherein a main constituent of the full-ceramic hearth roll consists essentially of silicon nitride with use of an Al—Y-based sintering aid.

3. The method of annealing the steel sheet according to claim 1, further comprising adjusting the torque of each of the hearth rolls such that a difference between a torque of the full-ceramic hearth roll and a torque of one hearth roll of the hearth rolls made of another material becomes equal to or smaller than 1%.

4. A steel sheet annealing furnace, comprising:

hearth rolls configured to support and convey the steel sheet; and a full-ceramic hearth roll located in an area where a furnace temperature is equal to or higher than 950° C., the full-ceramic hearth roll being a hearth roll in which an entire shaft portion of roll body are made of ceramic, wherein a main constituent of the full-ceramic hearth roll is silicon nitride with use of an Al—Y-based sintering aid; and a torque adjuster configured to adjust a torque of each hearth rolls such that a difference between a torque of the full-ceramic hearth roll and a torque of one hearth roll of the hearth rolls made of another material becomes equal to or smaller than 5%, when the full-ceramic hearth roll is used together with the hearth roll made of another material in the annealing furnace.

5. The steel sheet annealing furnace according to claim 4, wherein a main constituent of the full-ceramic hearth roll consists essentially of silicon nitride with use of an Al—Y-based sintering aid.

6. The steel sheet annealing furnace according to claim 4, wherein the torque adjuster is configured to adjust a torque of each hearth rolls such that a difference between a torque of the full-ceramic hearth roll and a torque of one hearth roll of the hearth rolls made of another material becomes equal to or smaller than 1%.

* * * * *